US011313051B2

(12) United States Patent
Yu et al.

(10) Patent No.: US 11,313,051 B2
(45) Date of Patent: Apr. 26, 2022

(54) COMPOSITE FABRIC AND METHOD FOR MAKING THE SAME

(71) Applicant: WINN APPLIED MATERIAL, INC., Changhua County (TW)

(72) Inventors: Chung-Ming Yu, Changhua County (TW); Shi-Wei Wang, Changhua County (TW); Shih-Hao Wang, Changhua County (TW)

(73) Assignee: WINN APPLIED MATERIAL INC., Changhua County (TW)

( * ) Notice: Subject to any disclaimer, the term of this patent is extended or adjusted under 35 U.S.C. 154(b) by 126 days.

(21) Appl. No.: 16/564,121

(22) Filed: Sep. 9, 2019

(65) Prior Publication Data

US 2020/0173066 A1 Jun. 4, 2020

(30) Foreign Application Priority Data

Nov. 30, 2018 (TW) ..... 107216352

(51) Int. Cl.

| | |
|---|---|
| ***D03D 15/00*** | (2021.01) |
| ***D01D 1/06*** | (2006.01) |
| ***D01D 1/04*** | (2006.01) |
| ***D01F 1/10*** | (2006.01) |
| ***D03D 15/547*** | (2021.01) |
| ***D03D 15/573*** | (2021.01) |
| ***D03D 15/283*** | (2021.01) |
| *D01D 5/088* | (2006.01) |
| *D01D 10/06* | (2006.01) |
| *D01D 5/16* | (2006.01) |
| *D01D 7/00* | (2006.01) |

(52) U.S. Cl.

CPC ..... *D01D 1/065* (2013.01); *D01D 1/04* (2013.01); *D01F 1/10* (2013.01); *D03D 15/283* (2021.01); *D03D 15/547* (2021.01); *D03D 15/573* (2021.01); *D01D 5/088* (2013.01); *D01D 5/16* (2013.01); *D01D 7/00* (2013.01); *D01D 10/06* (2013.01); *D10B 2101/06* (2013.01); *D10B 2331/10* (2013.01)

(58) Field of Classification Search

CPC ..... D01D 1/065; D01D 5/088; D01D 10/06; D01D 5/16; D01D 1/04; D01D 10/02; D01D 10/0436

See application file for complete search history.

(56) References Cited

U.S. PATENT DOCUMENTS 3,557,544 A * 1/1971 Simons ..... D01F 6/80 57/243
4,595,627 A * 6/1986 Steinman ..... D06Q 1/10 442/195

(Continued)

*Primary Examiner* — Niki Bakhtiari
*Assistant Examiner* — Emmanuel S Luk
(74) *Attorney, Agent, or Firm* — Guice Patents PLLC

(57) ABSTRACT

A method for manufacturing a composite fabric includes the steps of feeding, mixing and stirring, first drying, hot melt extrusion, first cooling, stretch extension, second cooling, winding-strands-into-roll, second drying, and weaving. The composite fabric is composed of multiple first threads and multiple second threads which are woven to the first threads. The first threads and the second threads are respectively reflective threads and glowing threads so that the composite fabric includes both features of light reflection and glowing in dark.

8 Claims, 13 Drawing Sheets

(56) References Cited

U.S. PATENT DOCUMENTS

| | | | | | |
|---|---|---|---|---|---|
| 5,202,182 | A * | 4/1993 | Knox | D01F 6/60 | 428/364 |
| 5,224,439 | A * | 7/1993 | O'Connell | B60Q 7/02 | 116/201 |
| 5,432,000 | A * | 7/1995 | Young, Sr. | A61F 13/15658 | 428/372 |
| 5,472,235 | A * | 12/1995 | Dubay | B60R 22/12 | 280/801.1 |
| 5,575,004 | A * | 11/1996 | Eisele | G08B 5/004 | 2/1 |
| 6,180,545 | B1 * | 1/2001 | Okeya | D04B 21/06 | 442/308 |
| 7,455,418 | B1 * | 11/2008 | Graham | A41D 20/00 | 362/103 |
| 9,273,417 | B2 * | 3/2016 | Gupta | D04H 1/435 | |
| 9,765,449 | B2 * | 9/2017 | Ise | D01D 5/16 | |
| 2003/0156426 | A1 * | 8/2003 | Givoletti | G02B 6/001 | 362/556 |
| 2006/0193582 | A1 * | 8/2006 | Ouderkirk | G02B 6/04 | 385/100 |
| 2013/0065042 | A1 * | 3/2013 | Esser-Kahn | B29C 67/202 | 428/389 |
| 2015/0044449 | A1 * | 2/2015 | Foss | A01N 25/10 | 428/221 |
| 2018/0142384 | A1 * | 5/2018 | Ogata | A41D 31/0005 | |
| 2019/0161891 | A1 * | 5/2019 | Estreicher | D03D 1/00 | |

* cited by examiner

COMPOSITE FABRIC AND METHOD FOR MAKING THE SAME

BACKGROUND OF THE INVENTION

1. Fields of the Invention

The present invention relates to a composite fabric and a method for making the composite fabric, and more particularly, the composite fabric includes features of stickiness, light reflection and glowing in dark.

2. Descriptions of Related Art

The conventional fabric are woven by multiple threads, and the threads may have different colors and/or materials. In order to obtain multiple features or functions of a piece of fabric, different types of materials are used to the threads. However, the conventional threads we use today has only one feature or function, therefore, multiple pieces of fabric needs to be combined to have multiple features or functions. For example, three pieces of fabric of different features are combined together by way of weaving. Nevertheless, the piece that is sandwiched between the other two pieces of fabric cannot perform its feature. The thickness the combination of the three pieces of fabric becomes a concern.

The present invention intends to provide a composite fabric and a method for making the composite fabric to allow the fabric to have multiple features which the thickness is minimum.

SUMMARY OF THE INVENTION

The present invention relates to a composite fabric which comprises a plurality of first threads and a plurality of second threads. Each first thread comprises a plurality of thermoplastic polyurethane particles and a plurality of glass particles. The glass particles are added and mixed into the plurality of thermoplastic polyurethane particles during a melting process of the plurality of thermoplastic polyurethane particles. Each first thread is produced by way of extracting after the glass particles and the plurality of thermoplastic polyurethane particles are mixed and hardened. Each first thread reflects light under illumination. Each second thread comprises a plurality of thermoplastic polyurethane particles and a glowing material. The glowing material is added and mixed with the plurality of thermoplastic polyurethane particles during a melting process of the plurality of thermoplastic polyurethane particles. Each second thread is produced by way of extracting after the glowing material and the plurality of thermoplastic polyurethane particles are mixed and hardened. Each second thread absorbs light and glows in a dark place. The first threads and the second threads are woven together to form a composite fabric by way of weaving. Therefore, the composite fabric includes two features of light reflection and glowing in a dark place.

The method for manufacturing the composite fabric comprises the following steps:

a step of feeding: preparing and inputting a plurality of thermoplastic polyurethane particles into two stirring drums, and adding a coupler into each stirring drum;

a step of mixing and stirring: mixing and stirring the plurality of thermoplastic polyurethane particles with the coupler in each stirring drum;

a step of first drying: drying the plurality of thermoplastic polyurethane particles in each stirring drum by a dryer to remove excess water, melting the plurality of thermoplastic polyurethane particles, wherein the drying temperature of the dryer is from 100° C. to 150° C., one of the two stirring drums is added with a plurality of glass particles, and the other of the two stirring drums is added with a glowing material;

a step of hot melt extrusion: sending the plurality of thermoplastic polyurethane particles that are melted in each stirring drum into a thread molding machine to extrude and form a preliminary reflective thread and a preliminary glowing thread;

a step of first cooling: passing the preliminary reflective thread and the preliminary glowing thread through a cooling tank to shape the outer surface of each of the preliminary reflective thread and the preliminary glowing thread;

a step of stretch extension: passing the cooled preliminary reflective thread and preliminary glowing thread through a stretching area to perform a stretch extension, wherein the stretching area comprises a plurality of rollers which are disposed with an interval apart from each other and arranged in rows, the preliminary reflective thread and the preliminary glowing thread are driven by each roller and stretched;

a step of second cooling: entering the preliminary reflective thread and the preliminary glowing thread into a cooling area which is disposed next to the stretching area, the preliminary reflective thread and the preliminary glowing thread being cooled to reduce surface deformation and to fix a shape of interior thereof, so that the preliminary reflective thread and the preliminary glowing thread form a reflective semi-finished thread and a glowing semi-finished thread respectively;

a step of winding-strands-into-roll: collecting and scrolling the reflective semi-finished thread and the glowing semi-finished thread to form a roll;

a step of second drying: using a dehumidifying and drying device 9 to dry the rolled reflective semi-finished thread and glowing semi-finished thread to reduce humidity in the reflective semi-finished thread and the glowing semi-finished thread, so that the reflective semi-finished thread and the glowing semi-finished thread form a plurality of first threads and a plurality of second threads respectively; and a step of weaving: weaving each first thread and each second thread together to form a piece of composite cloth.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
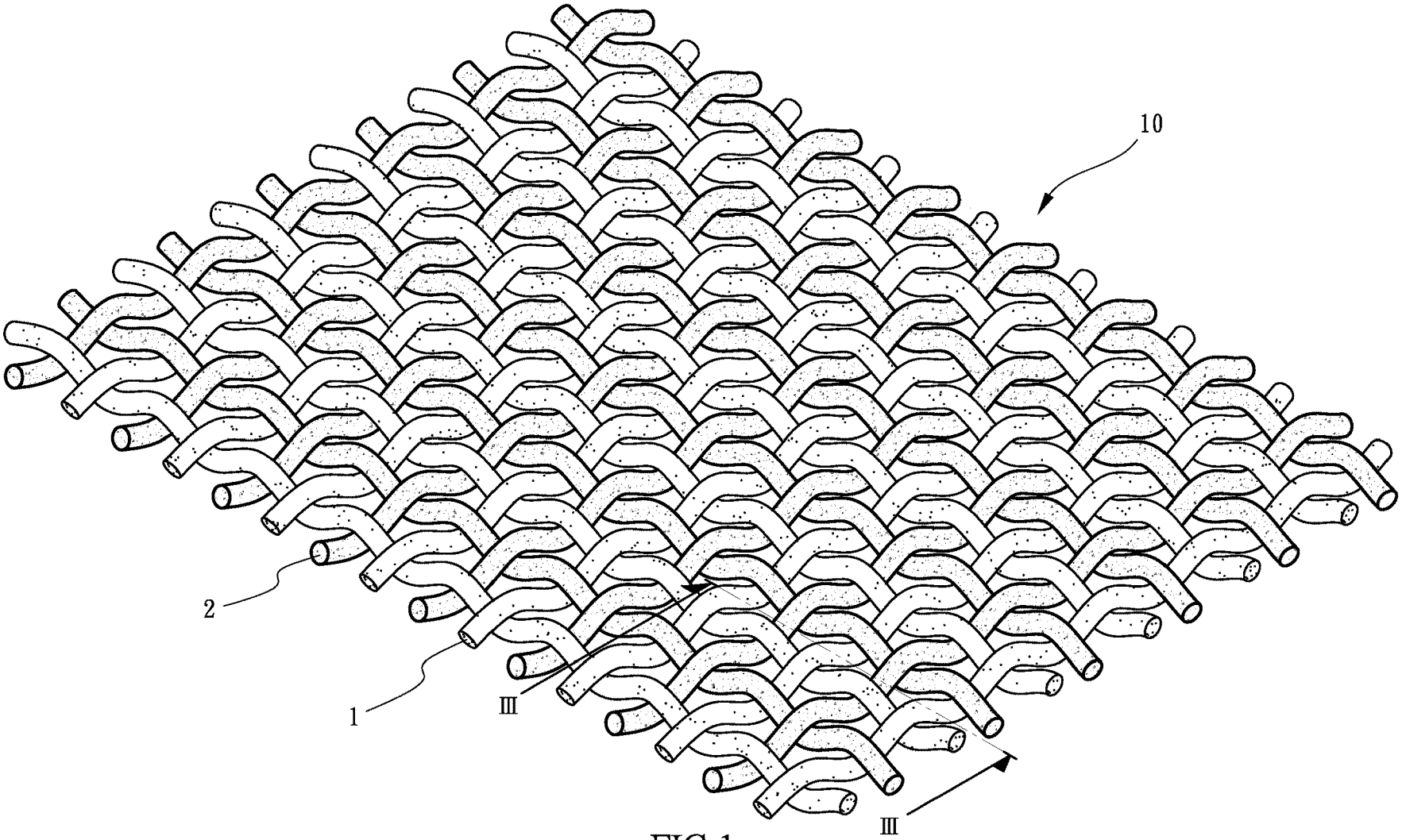
FIG. 1 is a perspective view to show the composite fabric of the present invention.
Figure 2:
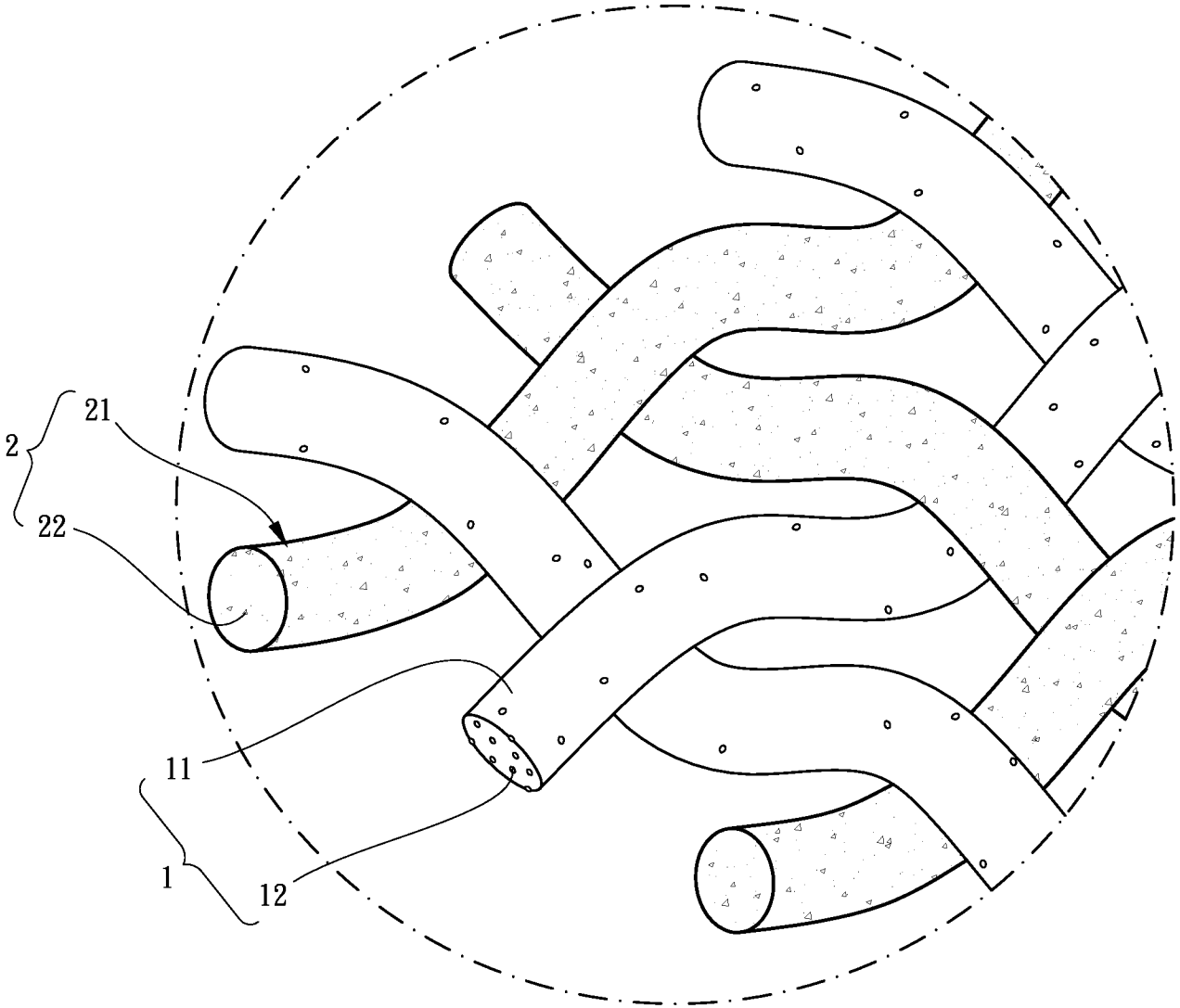
FIG. 2 is an enlarged view of a portion of the composite fabric of the present invention.
Figure 3:
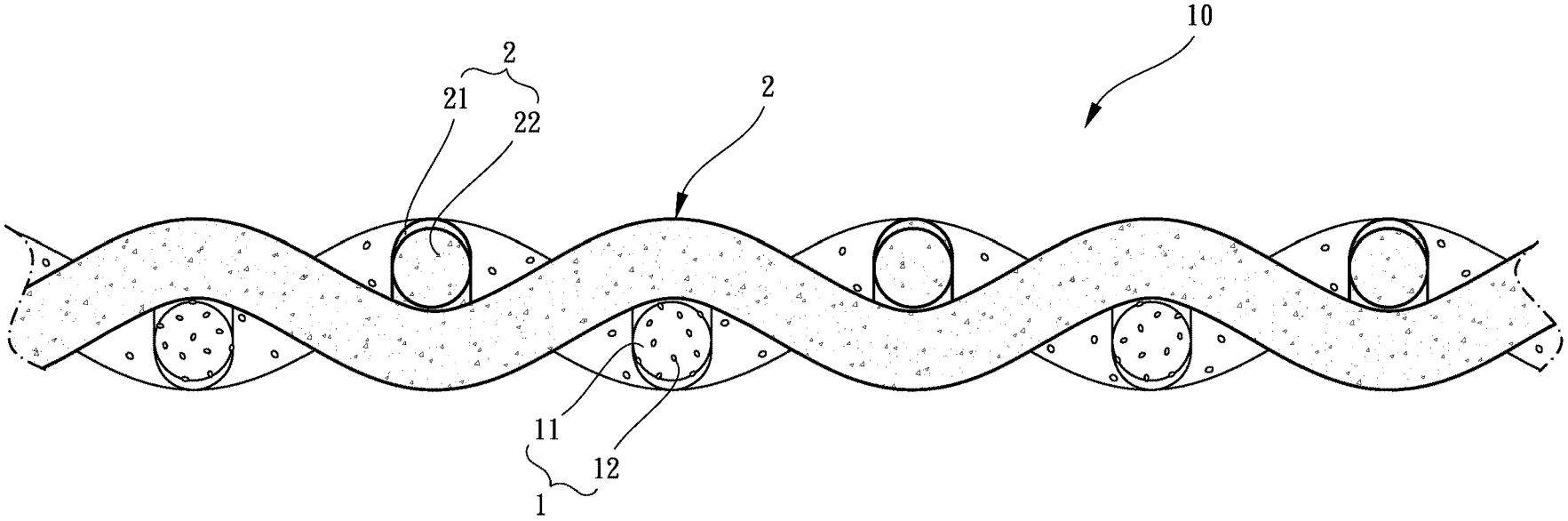
FIG. 3 is a cross sectional view, taken along line III-III of FIG. 1.
Figure 4:
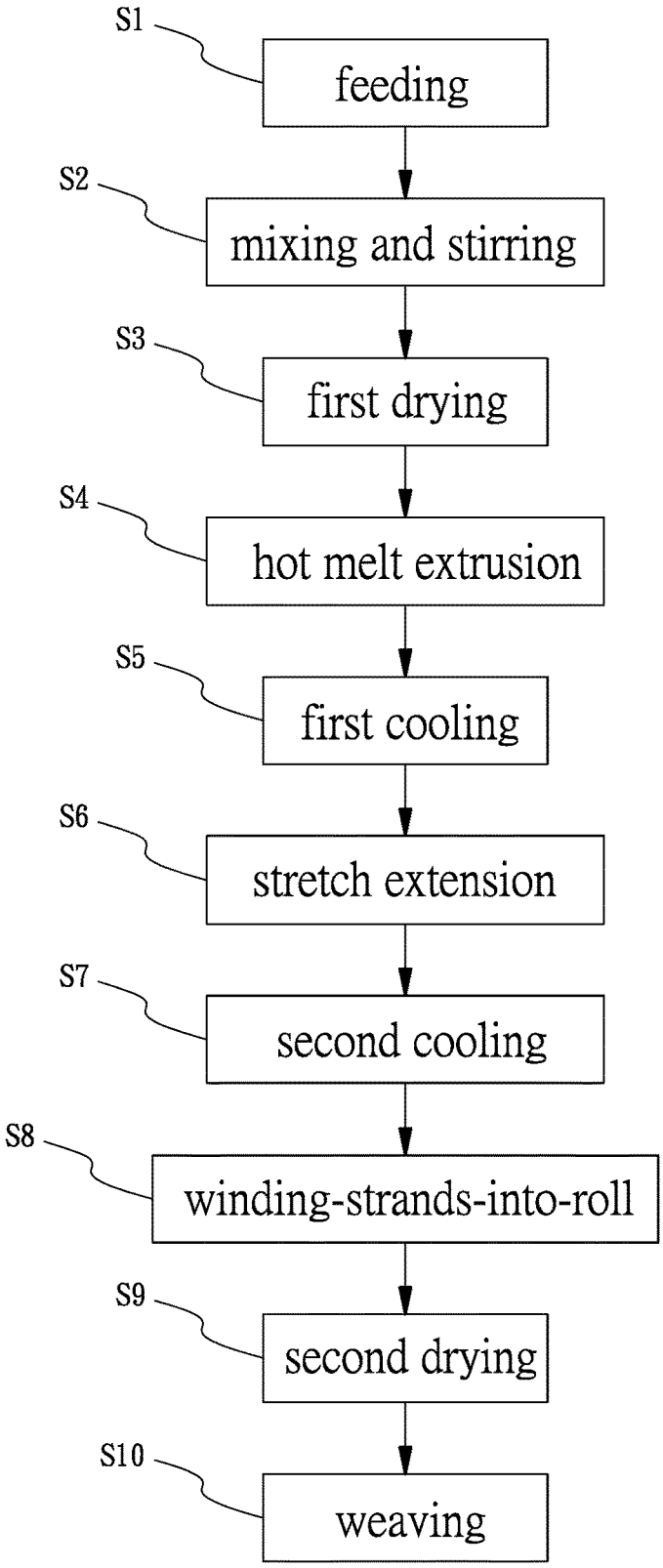
FIG. 4 shows the steps of the method of the present invention.
Figure 5:
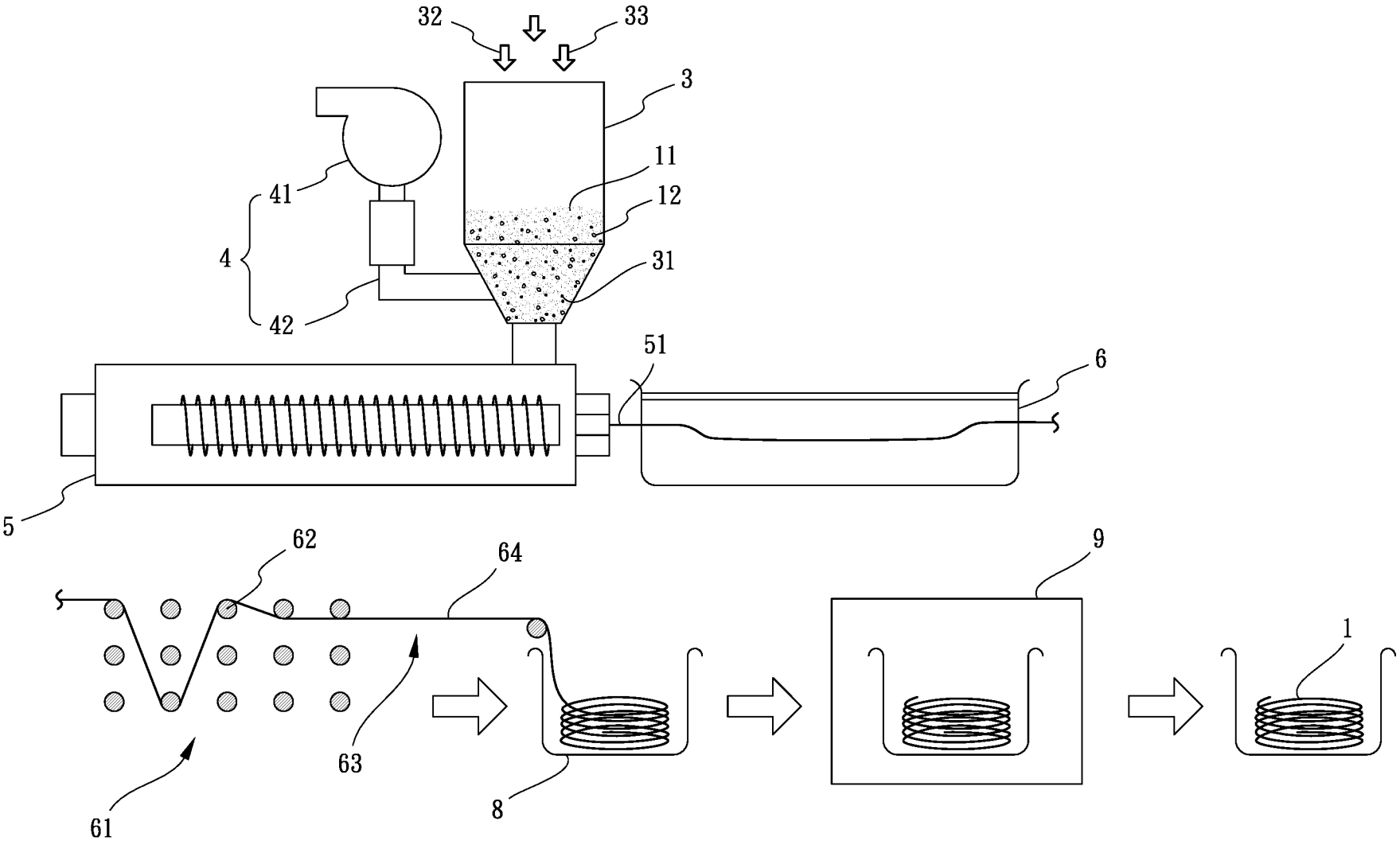
FIG. 5 illustrates that glass particles are added into the one of the two stirring drums in the step of first drying.
Figure 5A:
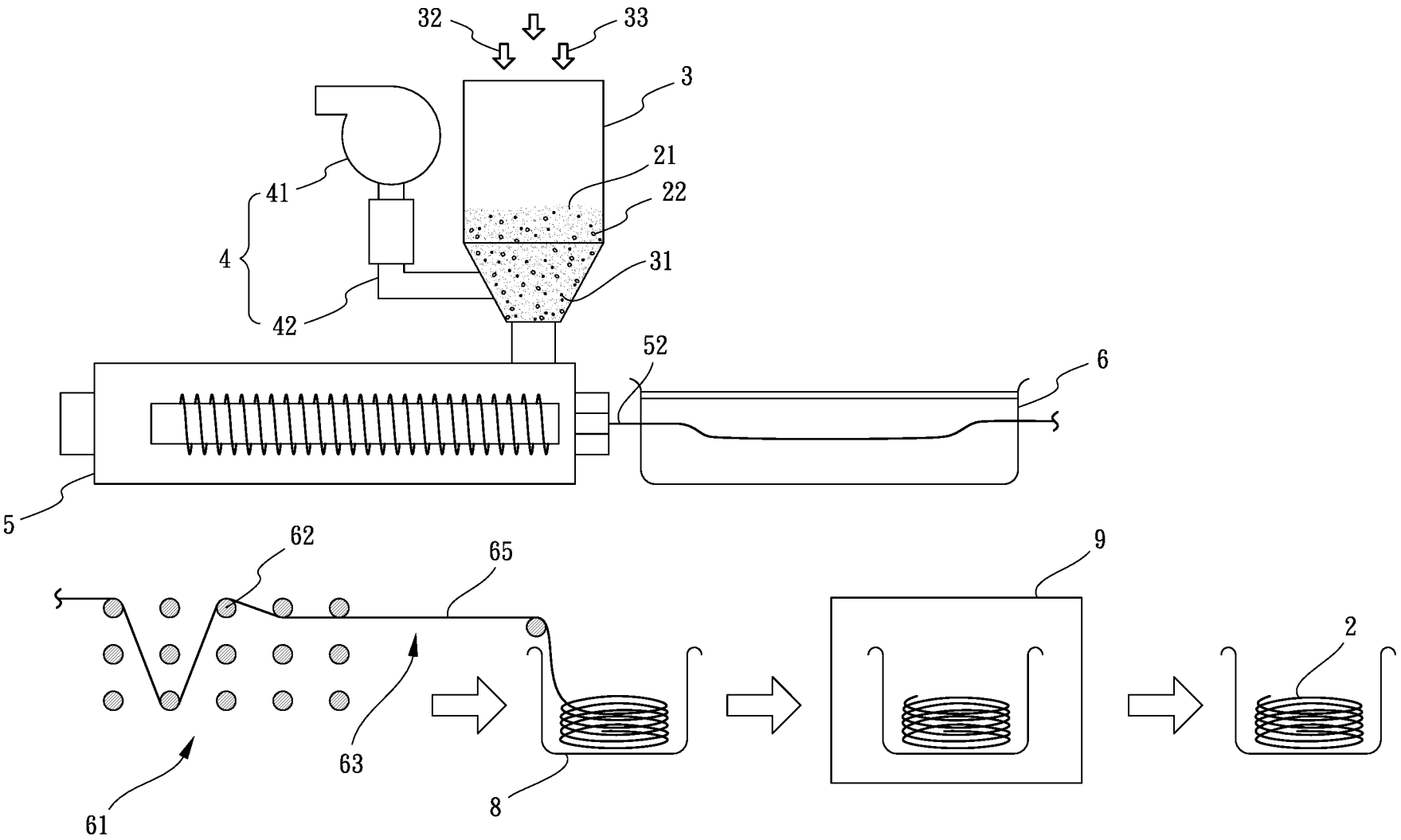
FIG. 5A illustrates that glowing material is added into the other one of the two stirring drums in the step of first drying.

Referring to FIGS. 1, 3, 6 and 7, the composite fabric 10 of the present invention comprises a plurality of first threads 1 and a plurality of second threads 2. Each first thread 1 comprises a plurality of thermoplastic polyurethane particles 11 and a plurality of glass particles 12. The glass particles 12 are added and mixed into the plurality of thermoplastic polyurethane particles 11 during a melting process of the plurality of thermoplastic polyurethane particles 11. Each first thread 1 is produced by way of extracting after the glass particles 12 and the plurality of thermoplastic polyurethane particles 1 are mixed and hardened. Each first thread 1 reflects light under illumination. Each second thread 2 comprises a plurality of thermoplastic polyurethane particles 21 and a glowing material 22. The glowing material 22 is added and mixed with the plurality of thermoplastic polyurethane particles 2 during a melting process of the plurality of thermoplastic polyurethane particles 21. Each second thread 2 is produced by way of extracting after the glowing material 22 and the plurality of thermoplastic polyurethane particles 21 are mixed and hardened. Each second thread 2 absorbs light and glows in a dark place. The first threads 1 and the second threads 2 are woven together to form a composite fabric 10 by way of weaving. Therefore, the composite fabric 10 includes two features of light reflection and glowing in a dark place.

Further referring to FIGS. 4, 5, 5A, 8, the method for manufacturing the composite fabric comprises the following steps:

A step S1 of feeding: preparing and inputting a plurality of thermoplastic polyurethane particles 11, 21 into two stirring drums 3, and adding a coupler 31 into each stirring drum 3.

1. A step S2 of mixing and stirring: mixing and stirring the plurality of thermoplastic polyurethane particles 11, 21 with the coupler 31 in each stirring drum 3 for 3 to 5 minutes so that the coupler 31 is coated to the thermoplastic polyurethane particles 11, 21. The plurality of thermoplastic polyurethane particles 11, 21 are polyester type or polyether type, or a combination of the polyester type and the polyether type. The melting point of the plurality of thermoplastic polyurethane particles 11, 21 is from 190° C. to 220° C. The coupler 31 is a mixture of resin and thickener. A brightener 32 is added in the step S2 of mixing and stirring, wherein the proportion of the brightener 32 is 0.2%~0.4% of a total weight of the plurality of thermoplastic polyurethane particles 11, 21. The brightener 32 makes the thermoplastic polyurethane particles 11, 21 brighter so that the composite fabric 10 looks clean. Alternatively, a pigment 33 is added and mixed in the step S2 of mixing and stirring so as to provide color to the thermoplastic polyurethane particles 11, 21. The composite fabric 10 looks with colorful appearance.

2. A step S3 of first drying: drying the plurality of thermoplastic polyurethane particles 11, 21 in each stirring drum 3 by a dryer 4 to remove excess water so that the thermoplastic polyurethane particles 11, 21 do not stick to each other because of the coupler 31 in the initial stage. The drying temperature of the dryer 4 is from 100° C. to 150° C., and the dryer 4 is operated for 15 to 60 minutes so that the plurality of thermoplastic polyurethane particles 11, 21 are melted to be semi-fluid status. One of the two stirring drums 4 is added with a plurality of glass particles 12, and the other of the two stirring drums 4 is added with a glowing material 22. The dryer 4 comprises a blower 41 and a heat pipe 42. Two ends of the heat pipe 42 communicate with the blower 41 and each stirring drum 3. The blower 41 blows heat air from the heat pipe 42 into each stirring drum 3 to dry and melt the plurality of thermoplastic polyurethane particles 11, 21. This ensures that the thermoplastic polyurethane particles 11, 21 are melted and evenly mixed with the glass particles 12 and the glowing material 22.

A step S4 of hot melt extrusion: sending the plurality of thermoplastic polyurethane particles 11, 21 that are melted in each stirring drum 3 into a thread molding machine 5 to extrude and form a preliminary reflective thread 51 and a preliminary glowing thread 52.

A step S5 of first cooling: passing the preliminary reflective thread 51 and the preliminary glowing thread 52 through a cooling tank 6 to shape the outer surface of each of the preliminary reflective thread 51 and the preliminary glowing thread 52. The cooling tank 6 is filled with water or cooling liquid to cool the preliminary reflective thread 51 and the preliminary glowing thread 52.

A step S6 of stretch extension: passing the cooled preliminary reflective thread 51 and preliminary glowing thread 52 through a stretching area 61 to perform a stretch extension. The stretching area 61 comprises a plurality of rollers 62 which are disposed with an interval apart from each other and arranged in rows. The preliminary reflective thread 51 and the preliminary glowing thread 52 are driven by each roller 62 and stretched. The shape of the cross section of each of the preliminary reflective thread 51 and the preliminary glowing thread 52 can be controlled by controlling rotation speed of the rollers 62 and the tensions applied to the preliminary reflective thread 51 and the preliminary glowing thread 52.

A step S7 of second cooling: entering the preliminary reflective thread 51 and the preliminary glowing thread 52 into a cooling area 63 which is disposed next to the stretching area 61. The preliminary reflective thread 51 and the preliminary glowing thread 52 are cooled to reduce surface deformation and to fix a shape of interior thereof, so that the preliminary reflective thread 51 and the preliminary glowing thread 52 form a reflective semi-finished thread 64 and a glowing semi-finished thread 65 respectively.

A step S8 of winding-strands-into-roll: collecting and scrolling the reflective semi-finished thread 64 and the glowing semi-finished thread 65 to form a roll. A rotary disc 7 is provided for the step S8 of winding-strands-into-roll to wind the reflective semi-finished thread 64 and the glowing semi-finished thread 65. Alternatively, a container 8 is placed in the cooling area 63, and the container 8 is rotated to collect and scroll the reflective semi-finished thread 64 and the glowing semi-finished thread 65.

A step S9 of second drying: using a dehumidifying and drying device 9 to dry the rolled reflective semi-finished thread 64 and glowing semi-finished thread 65 for 48 hours to reduce humidity in the reflective semi-finished thread 64 and the glowing semi-finished thread 65, so that the reflective semi-finished thread 64 and the glowing semi-finished thread 65 form a plurality of first threads 1 and a plurality of second threads 2 respectively.

A step S10 of weaving: weaving each first thread 1 and each second thread 2 together to form a piece of composite cloth 10.

Figure 6:
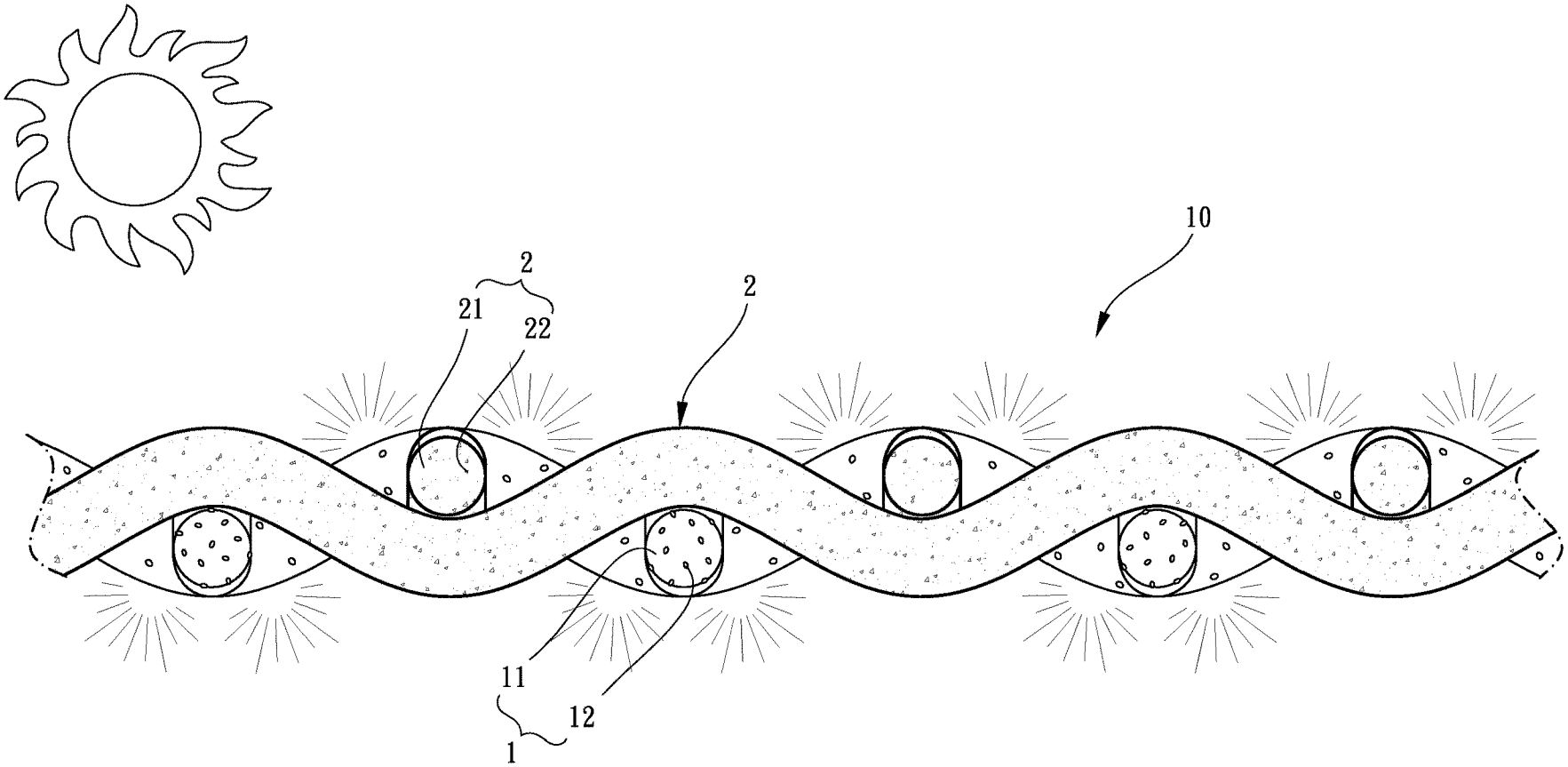
FIG. 6 illustrates that the composite fabric reflects light.
Figure 7:
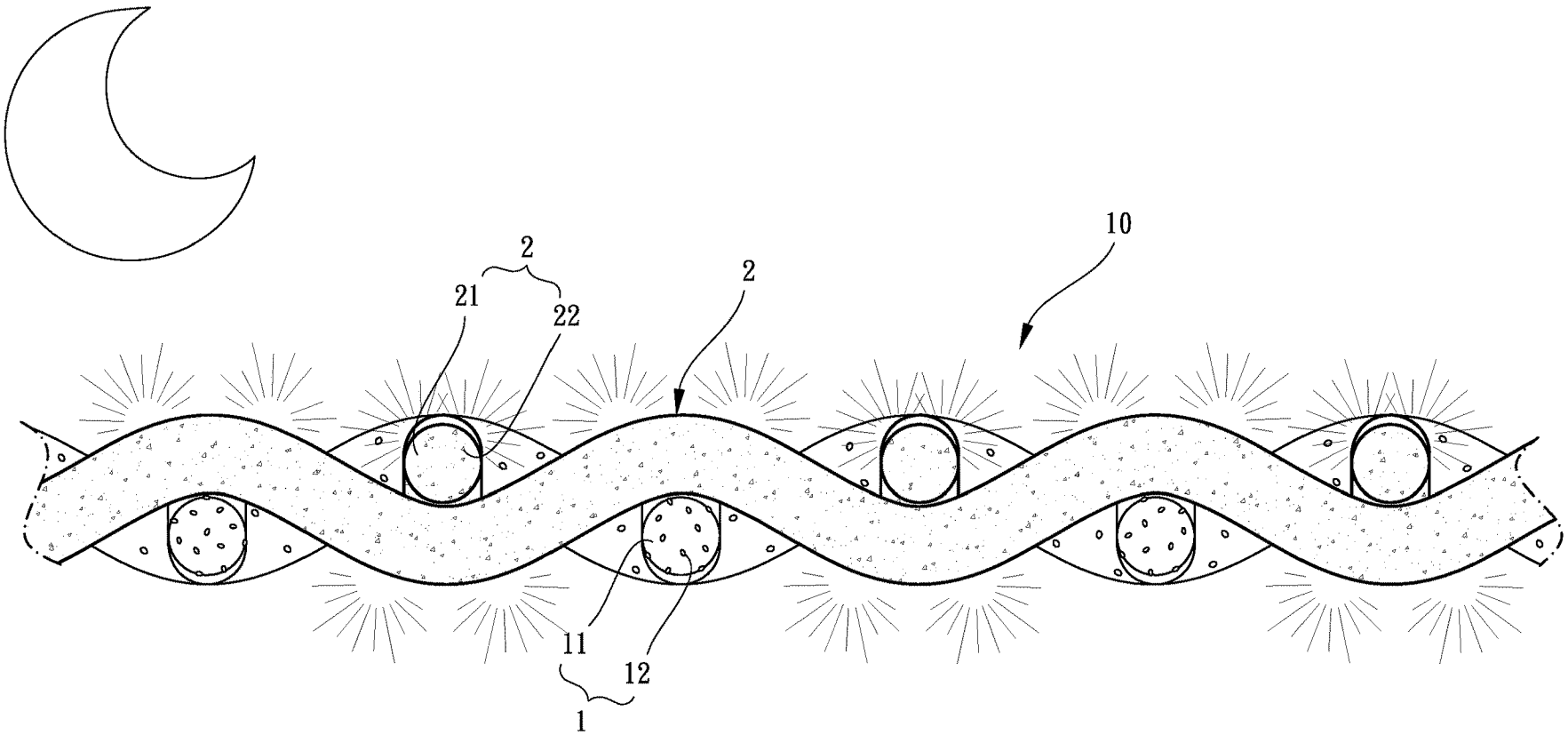
FIG. 7 illustrates that the composite fabric glows in the dark.
Figure 8:
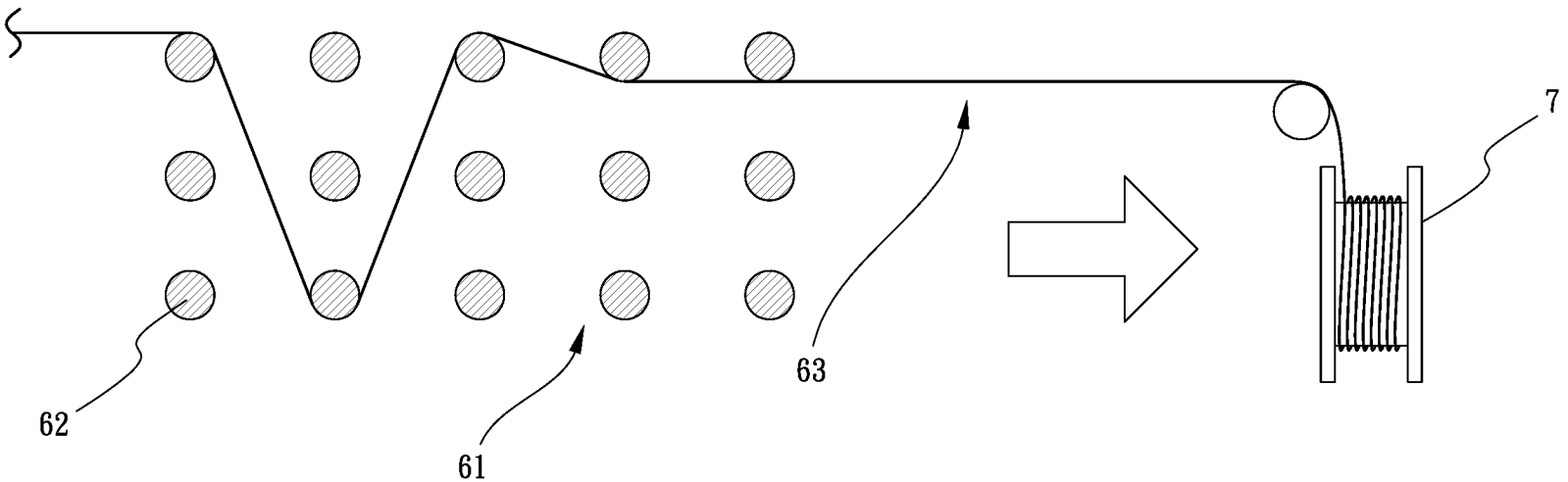
FIG. 8 shows another embodiment of the step of winding-strands-into-roll.
Figure 9:
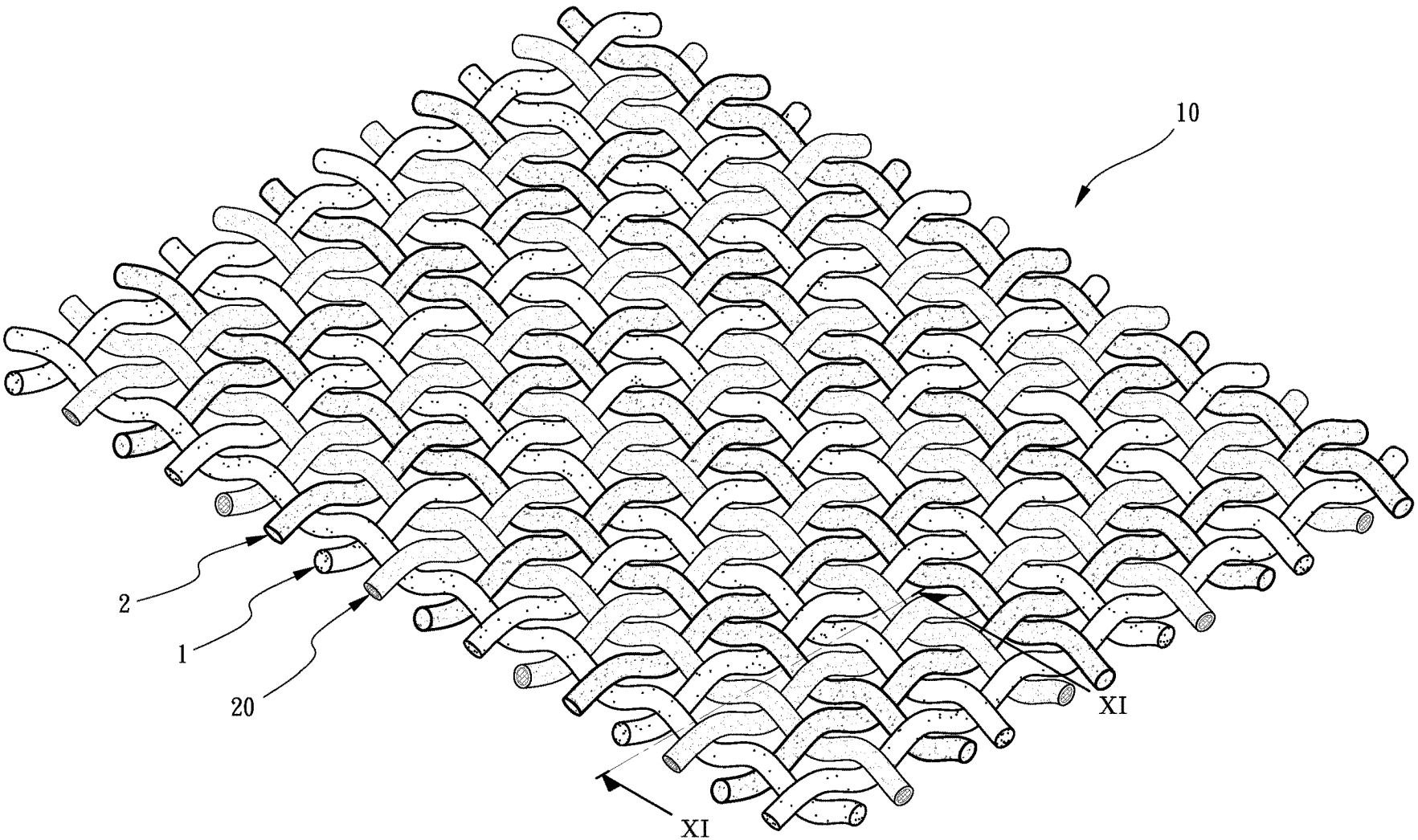
FIG. 9 shows that the composite fabric includes third threads.
Figure 10:
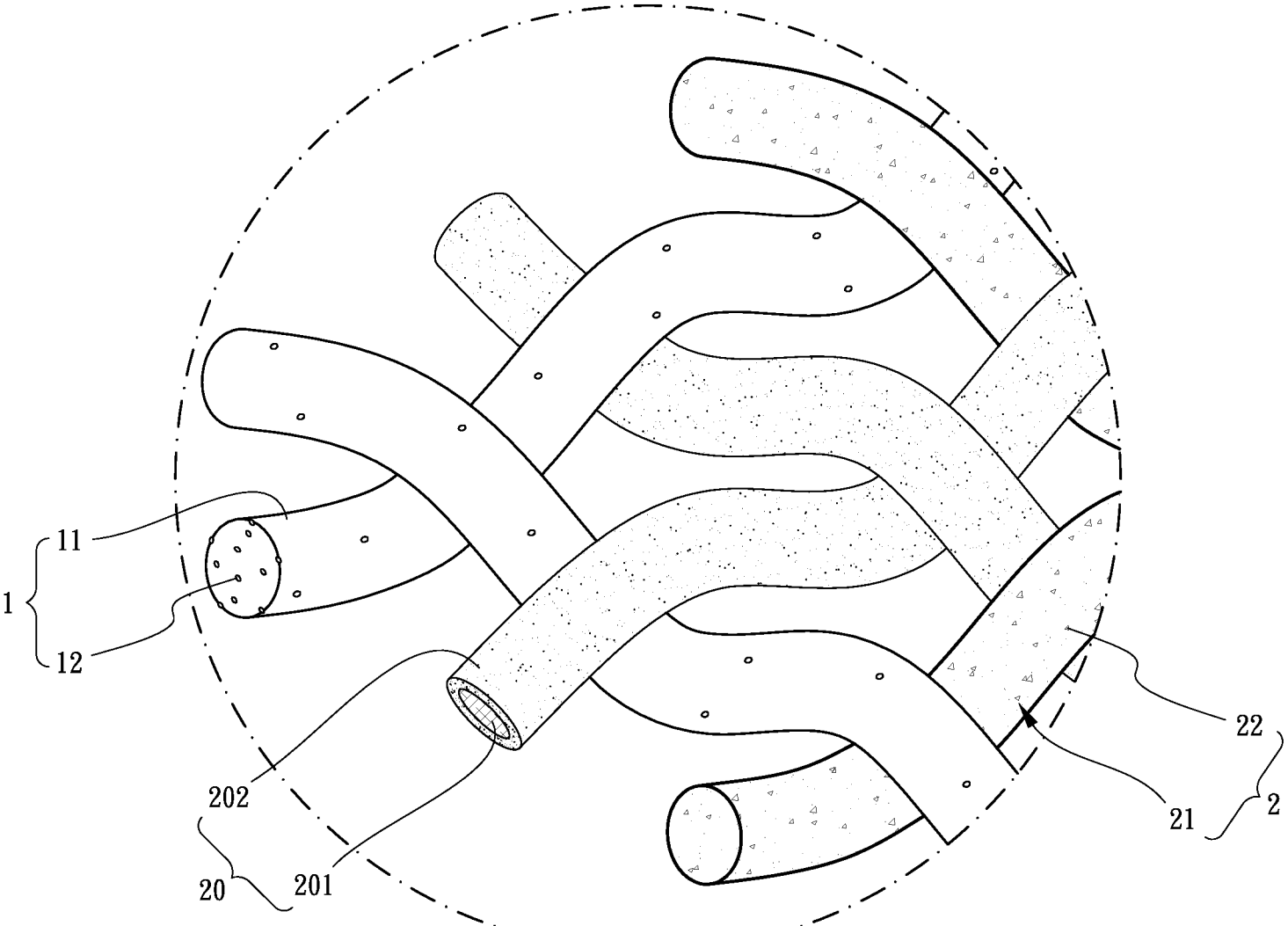
FIG. 10 is an enlarged view of a portion of the composite fabric of the present invention in FIG. 9.
Figure 11:
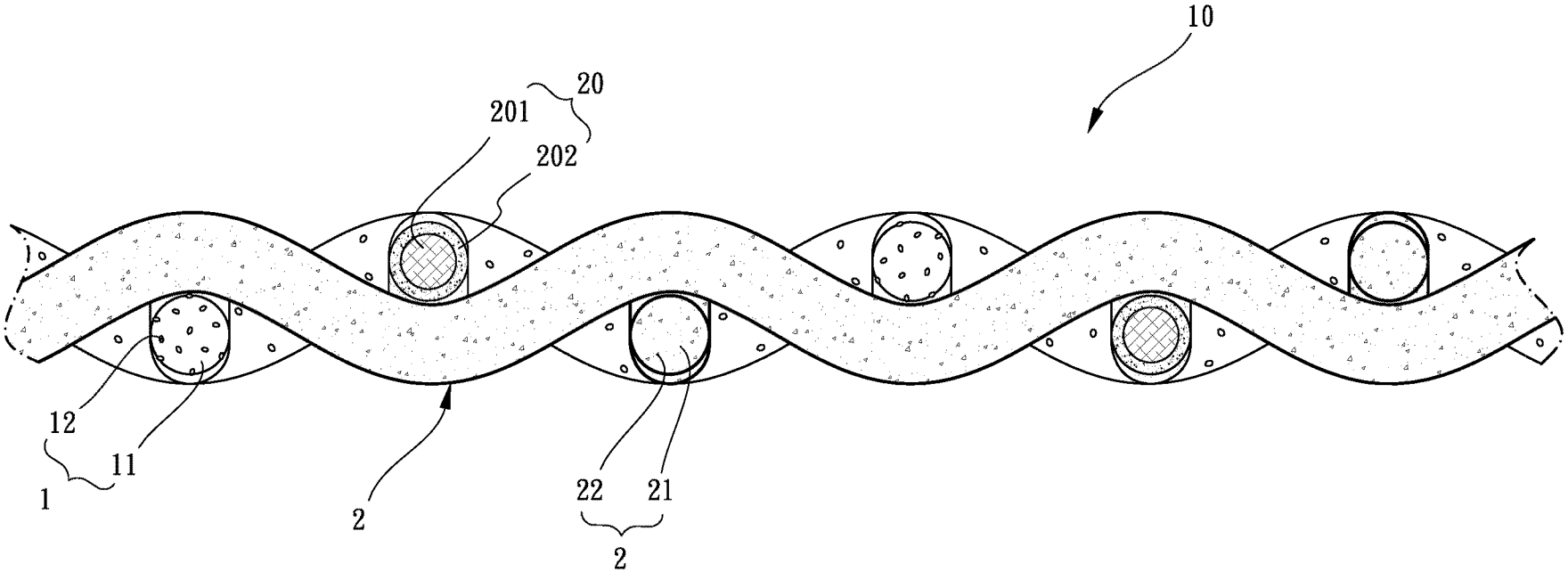
FIG. 11 is a cross sectional view, taken along line XI-XI of FIG. 9.
Figure 12:
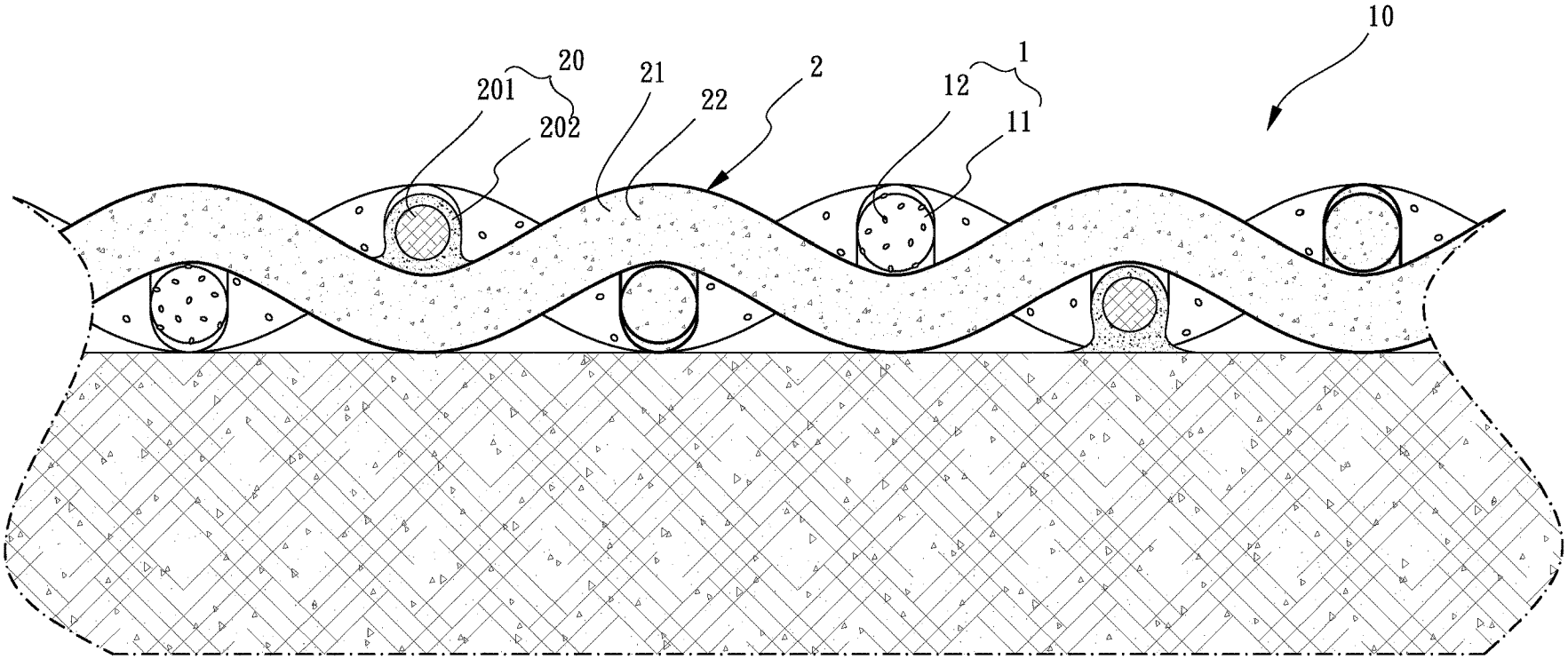
FIG. 12 shows that the composite fabric as disclosed in FIG. 9 is attached to another piece of fabric.

As shown in FIGS. 6 and 7, the first threads 1 comprise glass particles so that the first threads 1 reflect light which provides attraction and has warning feature. The second threads 2 comprise glowing material 22 which absorbs light in the day time, and glows in the dark area so that wearers are seen in the dark. The melted thermoplastic polyurethane particles 11, 21 are mixed with the coupler 31 to have stickiness, so that the composite fabric 10 can be easily attached to objects or another piece of fabric.

Specifically, the plurality of thermoplastic polyurethane particles 11 and the plurality of glass particles 12 of each first thread 1 have a weight ratio of 1:1, so that the composite fabric 10 reflects light evenly and does not flare. Each first thread 1 and each second thread 2 have the same thickness such that the composite fabric has a flat surface. Each first thread 1 and each second thread 2 are woven together to form a plain woven fabric, a rib knitted fabric, a corrugated fabric or a rib weft knitted fabric by a weaving method a plain weaving method, a knitting method, or any combination of the above. As shown in FIGS. 9 to 12, the composite fabric may comprises a plurality of third threads 20, wherein each third thread 20 includes a tedron high-strength yarn layer 201 disposed at the center thereof, and an adhesive layer 202 coated onto the tedron high-strength yarn layer 201. The third threads 20 are woven with each first thread 1 and each second thread 2 together, and then the adhesive layer 202 is heated to be semi-fluid status so that the third threads 20 of the composite fabric 10 are sticky and can be easily attached to an object or another piece of fabric. The adhesive layer 202 is thermo-plastic-rubber material.

The composite fabric 10 is easily attached to an object such as a hard-case suitcase, a plastic object or another piece of fabric by simply heating or baking the composite fabric 10 to melt the first and second thermoplastic polyurethane particles 11, 21 which are mixed with the coupler 31 to have a certain degree of stickiness. The composite fabric 10 is cable to be sandwiched between two pieces of fabric of different materials by the stickiness. Therefore, the use of the composite fabric 10 to objects does not need glue or adhesive.

While we have shown and described the embodiment in accordance with the present invention, it should be clear to those skilled in the art that further embodiments may be made without departing from the scope of the present invention.

What is claimed is:

1. A method for manufacturing a composite fabric, comprising the steps of:

a step of feeding: preparing and inputting a plurality of thermoplastic polyurethane particles into two stirring drums, and adding a coupler into each stirring drum;

a step of mixing and stirring: mixing and stirring the plurality of thermoplastic polyurethane particles with the coupler in each stirring drum;

a step of first drying: drying the plurality of thermoplastic polyurethane particles in each stirring drum by a dryer to remove excess water, melting the plurality of thermoplastic polyurethane particles, wherein a drying temperature of the dryer is from 100° C. to 150° C., one of the two stirring drums is added with a plurality of glass particles, and the other of the two stirring drums is added with a glowing material;

a step of hot melt extrusion: sending the plurality of thermoplastic polyurethane particles that are melted in each stirring drum into a thread molding machine to extrude and form a preliminary reflective thread and a preliminary glowing thread;

a step of first cooling: passing the preliminary reflective thread and the preliminary glowing thread through a cooling tank to shape an outer surface of each of the preliminary reflective thread and the preliminary glowing thread;

a step of stretch extension: passing the cooled preliminary reflective thread and preliminary glowing thread through a stretching area to perform a stretch extension, wherein the stretching area comprises a plurality of rollers which are disposed with an interval apart from each other and arranged in rows, the preliminary reflective thread and the preliminary glowing thread are driven by each roller and stretched;

a step of second cooling: entering the preliminary reflective thread and the preliminary glowing thread into a cooling area which is disposed next to the stretching area, the preliminary reflective thread and the preliminary glowing thread being cooled to reduce surface deformation and to fix a shape of interior thereof, so that the preliminary reflective thread and the preliminary glowing thread form a reflective semi-finished thread and a glowing semi-finished thread respectively;

a step of winding-strands-into-roll: collecting and scrolling the reflective semi-finished thread and the glowing semi-finished thread to form a roll;

a step of second drying: using a dehumidifying and drying device to dry the rolled reflective semi-finished thread and glowing semi-finished thread to reduce humidity in the reflective semi-finished thread and the glowing semi-finished thread, so that the reflective semi-finished thread and the glowing semi-finished thread form a plurality of first threads and a plurality of second threads respectively; and a step of weaving: weaving each first thread and each second thread together to form a piece of composite cloth.

2. The method as claimed in claim 1, wherein the plurality of thermoplastic polyurethane particles are polyester or polyether, or a combination of the polyester and the polyether, a melting point of the plurality of thermoplastic polyurethane particles is from 190° C. to 220° C., the coupler is a mixture of resin and thickener.

3. The method as claimed in claim 2, wherein a brightener is added in the step of mixing and stirring, a weight percent proportion of the brightener is 0.2%~0.4% of a total weight of the plurality of thermoplastic polyurethane particles.

4. The method as claimed in claim 3, wherein a pigment is added and mixed in the step of mixing and stirring.

5. The method as claimed in claim 4, wherein a stirring time of the step of mixing and stirring is from 3 to 5 minutes.

6. The method as claimed in claim 5, wherein the dryer comprises a blower and a heat pipe, two ends of the heat pipe communicate with the blower and each stirring drum, the blower blows heat air from the heat pipe into each stirring drum to dry the plurality of thermoplastic polyurethane particles.

7. The method as claimed in claim 6, wherein a rotary disc is provided for the step of winding-strands-into-roll to wind the reflective semi-finished thread and the glowing semi-finished thread, or a container is placed in the cooling area, and the container is rotated to collect and scroll the reflective semi-finished thread and the glowing semi-finished thread.

8. The method as claimed in claim 6, wherein a drying time of the step of first drying is from 15 to 60 minutes.

* * * * *